US009734936B2

(12) United States Patent
Hassel et al.

(10) Patent No.: US 9,734,936 B2
(45) Date of Patent: Aug. 15, 2017

(54) CABLE FOR DOWN HOLE PUMP

(71) Applicant: NEXANS, Paris (FR)

(72) Inventors: Arild Hassel, Drammen (NO); Robin Sangar, Oslo (NO); Jorn Wardeberg, Billingstad (NO)

(73) Assignee: NEXANS, Paris (FR)

( * ) Notice: Subject to any disclaimer, the term of this patent is extended or adjusted under 35 U.S.C. 154(b) by 57 days.

(21) Appl. No.: 14/506,814

(22) Filed: Oct. 6, 2014

(65) Prior Publication Data

US 2015/0136435 A1 May 21, 2015

(30) Foreign Application Priority Data

Nov. 18, 2013 (NO) ..... 20131531

(51) Int. Cl.

| | |
|---|---|
| ***H01B 9/02*** | (2006.01) |
| ***H01B 7/00*** | (2006.01) |
| ***H01B 7/04*** | (2006.01) |
| ***E21B 43/12*** | (2006.01) |
| ***H01B 1/02*** | (2006.01) |
| ***H01B 3/42*** | (2006.01) |
| ***H01B 7/29*** | (2006.01) |
| ***H01B 11/22*** | (2006.01) |

(52) U.S. Cl.

CPC ..... *H01B 7/0072* (2013.01); *E21B 43/128* (2013.01); *H01B 1/026* (2013.01); *H01B 3/421* (2013.01); *H01B 7/046* (2013.01); *H01B 7/292* (2013.01); *H01B 11/22* (2013.01)

(58) Field of Classification Search

CPC ..... H01B 7/226; H01B 9/023; H01B 7/181; H01B 7/1815; H01B 7/182; H01B 7/1825; H01B 17/00; H01B 17/14; H01B 7/0072; H01B 7/046; H01B 1/026; H01B 3/421; H01B 7/292; H01B 11/22; E21B 43/128

USPC ..... 174/102 R, 106 R, 47, 116

See application file for complete search history.

(56) References Cited

U.S. PATENT DOCUMENTS

| | | | | |
|---|---|---|---|---|
| 3,812,283 | A * | 5/1974 | Kothe | H02G 15/10 174/105 R |
| 3,832,481 | A | 8/1974 | Boyd et al. | |
| 4,440,974 | A * | 4/1984 | Naudet | 174/108 |
| 4,679,898 | A * | 7/1987 | Grooten | G02B 6/4416 174/105 R |
| 4,979,795 | A * | 12/1990 | Mascarenhas | 385/107 |
| 5,086,196 | A * | 2/1992 | Brookbank et al. | 174/106 R |
| 5,355,720 | A * | 10/1994 | Bailey | G01M 3/165 324/533 |
| 5,384,430 | A * | 1/1995 | Anthony et al. | 174/115 |

(Continued)

FOREIGN PATENT DOCUMENTS

| | | |
|---|---|---|
| EP | 2204823 | 7/2010 |
| WO | 2011106513 | 9/2011 |

*Primary Examiner* — Pete Lee

(74) *Attorney, Agent, or Firm* — Sofer & Haroun, LLP

(57) ABSTRACT

A cable is provided for suspending a down hole pump that has a core with at least one tube for the transport of fluid and at least one conductor covered with an insulation layer made of a high temperature resistant insulating material. The core is covered by a steel tape and a first layer of steel wires are positioned radially outside the steel tape in contact with the steel tape. The wires of the first layer of steel wires are positioned side by side around the core with no filler in between the steel wires and an outer layer made of heat resistant polymer covers the steel wires.

8 Claims, 1 Drawing Sheet

(56) References Cited

U.S. PATENT DOCUMENTS

| | | | | |
|---|---|---|---|---|
| 7,541,089 | B1 * | 6/2009 | Miksic | C04B 18/022<br>252/388 |
| 2007/0000682 | A1 * | 1/2007 | Varkey | H01B 7/046<br>174/102 R |
| 2012/0024565 | A1 * | 2/2012 | Orini | 174/106 R |
| 2012/0168199 | A1 * | 7/2012 | McCullough et al. | 174/113 R |
| 2013/0287348 | A1 * | 10/2013 | Register et al. | 385/101 |
| 2014/0076606 | A1 * | 3/2014 | Patel | H01B 3/445<br>174/102 A |

* cited by examiner

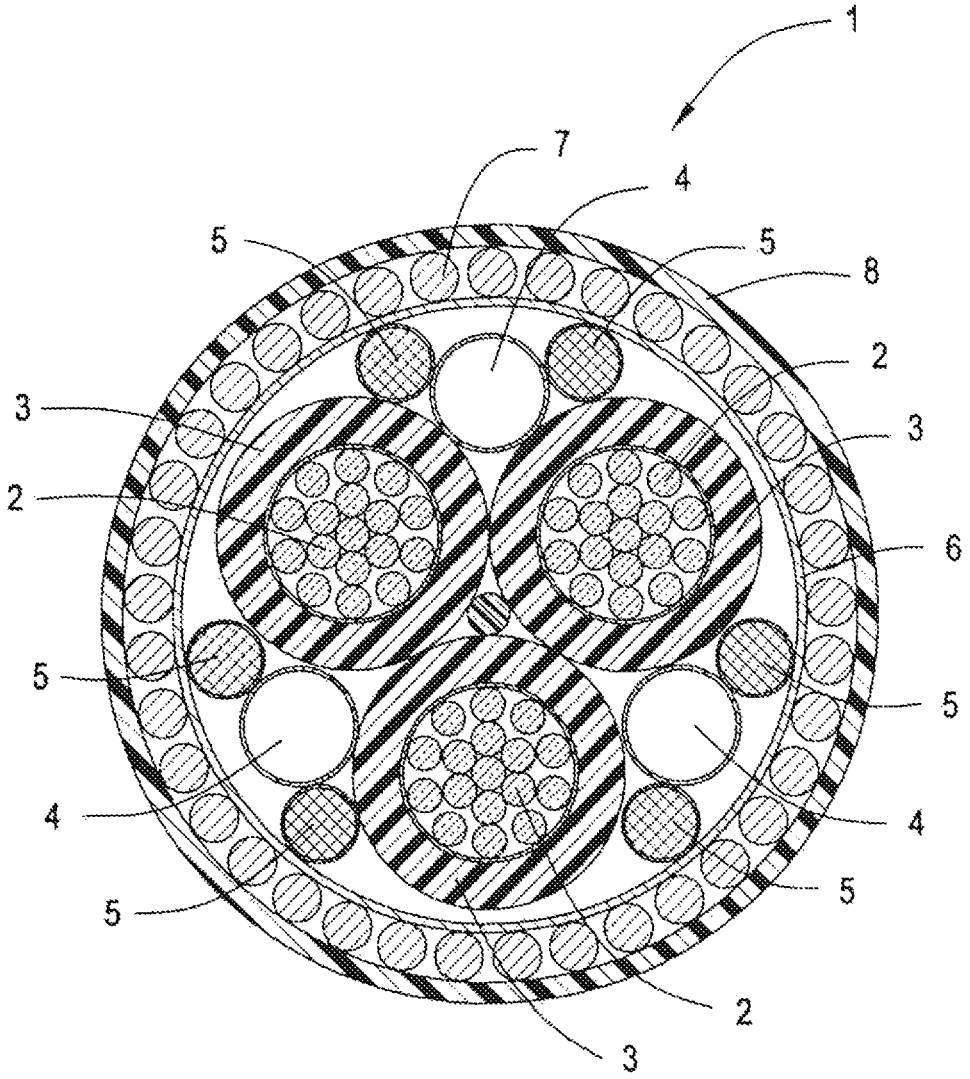
1
7
4
5
5
8
2
3
3
2
6
5
5
4
4
5
5
2
3

CABLE FOR DOWN HOLE PUMP

RELATED APPLICATION

This application claims the benefit of priority from Norwegian Patent Application No. 2013 1531, filed on Nov. 18, 2013, the entirety of which is incorporated by reference.

BACKGROUND

Field of the Invention

The invention concerns a cable for suspending a down hole pump in a well bore. The cable may also be usable for other applications such as fluid sampling and geophysical applications.

Description of Related Art

A cable to be used down hole needs to fulfill complex requirements; the cable should be of light weight and have a small diameter. Further, the cable will be employed at high temperatures, in one embodiment about 170° C. Consequently the cable structure must be provided to withstand the impact of high temperature without severe deterioration of the mandatory structural and functional features of the cable for fulfilling the specific use of the cable.

When using the cable for suspending a down hole pump, the cable must have structural provisions for enduring excessive tensile loads and high external pressures.

During down hole use the cable is exposed to aggressive chemicals and dissolved gases such as CO2 and H2S. The gases present in the environment of the bore hole tend to diffuse into voids in the cable and may accumulate in internal voids in the cable. This effect is especially pronounced at elevated temperatures. Such accumulated gases represent a potential hazard to the cable, and if the external pressure is reduced rapidly, for instance during retrieval of the cable or during adjustment of the borehole pressure the gases will expand and may cause damage to the cable.

Prior art publications relevant to the invention have been identified; U.S. Pat. No. 5,086,196 WO 2011106513, EP 2204823, U.S. Pat. No. 3,832,481.

U.S. Pat. No. 5,086,196 discloses an electro-mechanical cable for deploying pumping systems. The cable has a core comprising insulated conductors embedded in an elastomer core jacket which protects the conductors from mechanical damages as well as joining the conductors with the core jacket as a unit. A containment layer is wound on the core jacket in order to prevent outward radial expansion. An armour layer comprising helically wounded armour wires surround the containment layer and provide the axial strength to the cable.

WO 2011106513 discloses a cable with three conductors included in the core and a jacket layer surrounding the core. Plural wires for the provision of strength to the cable are positioned around the core outside the jacket layer. The wires are arranged with gaps filled with a polymer material in between the wires in the circumferential direction.

EP 2204823 shows an electro-mechanical cable with a core including conductors, wherein the core is encircled with an armour sheath comprising two layers of steel armour. The two armour layers comprises a plurality of interlocking strands wherein the surface of the strand is configured so that it matches the surface of a neighbouring strand for a locking effect. The armored layer provides axial strength to the cable as well as functioning as an anti-compression ring for resisting compression of the cable. A conduit for transport of fluid may be included in the electromechanical cable.

U.S. Pat. No. 3,832,181 shows a cable comprising conductors and the presence of various kinds of polymer for making up the layers of the cable.

OBJECTS AND SUMMARY

It is an object of the invention to provide a cable which suspends a down hole pump, which is provided for withstanding the above mentioned exposure to high temperature, high loads and chemicals/gases, as well as other impacts when employing the cable in the bore hole. Hence it is a further object of the invention to prolong the lifetime of the cable and reduce the service interval for the down hole pump, as each service effectuates large expenses and delays for the total operation.

Specifically the cable needs to be able to carry the load of the down hole pump, it should further be able to deliver power to the down hole pump and deliver corrosion inhibitor from top side to the down hole pump.

These objects are achieved with the invention as defined in the independent claim. Further embodiments of the invention are defined in the following dependent claims.

A cable for suspending a down hole pump is provided in accordance with the invention. The cable has a core comprising at least one conductor and at least one tube for conveying fluid such as for instance a corrosion inhibitor or other suitable fluids which needs to be delivered to the down hole pump. Optical fibers may be passed down one of the tubes.

The at least one conductor may be covered with an insulation layer made of a high temperature resistant insulating material, for instance perfluoroalkoxy polymer. The core is covered with a steel tape. A first layer of steel wires are positioned radially outside the steel tape in contact with the steel tape. The steel tape protects the conductors from the wires. The wires making up the first layer are positioned side by side around the core with no filler in between the wires. The wires, which may comprise galvanized steel wires, provide axial strength to the cable. An outer layer made for instance of high temperature resistant polymer, covers the steel wires. The heat resistant polymer of the outer layer may comprise thermoplastic polyester.

The arrangement of this inventive cable, makes it possible to use a conventional cable spooling arrangement when deploying and retrieving the down hole pump.

Further, the core may be filled with filling elements, for instance made of perfluoroalkoxy polymer. The filling elements maintain the circular cross section of the cable, and thus the axial tensile properties of the cable. A circular cross section facilitates pressure sealing to the outer layer of the cable, where such sealing is required. The filling elements also minimize the voids inside the cable cross section.

The conductor may be made of Cu, and may be stranded or solid, and the number of conductors included in the core may be three. Further, the number of tubes may be three. The number of steel wires may be 37.

In one embodiment the cable may comprise an additional layer of steel wires arranged radially outside the first layer of steel wires. If two or more layers of wires are applied, they are often separated by a polymer film, and are often wound in alternate directions.

The diameter of the cable may be between 30-50 mm, and in some circumstance the diameter is advantageously chosen to be 45 mm.

BRIEF DESCRIPTION OF THE DRAWINGS

In the following an example of an embodiment of the invention will be described with reference to the FIGURE;

FIG. 1 shows a cross section through a radial plane of the cable in accordance with the invention.

DETAILED DESCRIPTION

In the embodiment of the cable 1 as shown in FIG. 1, three conductors 2 are included in the core of the cable 1. Each conductor, which may be a Cu conductor and may be stranded, is insulated with a layer 3, made of high temperature resistant insulating material such as perfluoroalkoxy polymer (PFA). In the shown embodiment the core also includes three tubes 4 for the transport of fluid and filling elements 5. In one embodiment of the invention optical fibres may be included in at least one of the three tubes 4.

A steel tape 6 covers the conductors 2, the tubes 4 and the filling elements 5, for the radial protection of the core. For the provision of axial strength to the cable, plural wires 7 are arranged helically wounded in contact with the steel tape 6 surrounding the core. The wires 7 may be stranded and may be made of galvanized steel. In the FIGURE, the cable 1 is shown with one layer of wires 7, but in an alternative embodiment of the cable two or more layers of wires 7 may be included in the cable 1, in which case each layer of wire may be separated from the next by a polymer film. The wires 7 included in each layer comprise plural wires arranged side by side without the use of filling elements in between the wires 7 of a layer.

An outer layer 8 of heat resistant polymer for instance of thermoplastic polyester (TPE) covers the wires 7. Perfluoroalkoxy polymer (PFA) may also be used making up the outer layer 8.

The invention claimed is:

1. A cable for suspending a down hole pump wherein said cable comprising: a core having at least one tube for the transport of fluid and at least one conductor covered with an insulation layer made of a high temperature resistant insulating material, said core further having filing elements made of perfluoroalkoxy polymer wherein the core is covered by a steel tape that is in contact with the insulation layer of the at least one conductor and at least two layers of steel wires are positioned radially outside the steel tape with a polymer film between said two layers of steel wires, wherein an inner layer of said two layers of steel wires being in direct contact with the steel tape, and wherein individual steel wires forming said inner layer have a total of 37 individual steel wires which are positioned side by side around the core and in direct contact with the steel tape with no filler in between the individual steel wires and an outer layer made of heat resistant polymer covering the individual steel wires, and wherein a total diameter of the cable is substantially 45 mm.

2. The cable in accordance with claim 1, wherein a total number of conductors within said cable is three.

3. The cable in accordance with claim 1, wherein a total number of tubes within said cable is three.

4. The cable in accordance with claim 1, wherein the conductor is made of copper.

5. The cable in accordance with claim 1, wherein the heat resistant polymer of the outer layer comprises thermoplastic polyester.

6. The cable in accordance with claim 3, wherein at least one of the tubes comprises optical fibres.

7. The cable in accordance with claim 1, wherein the high temperature resistant insulating material of the insulation layer comprises perfluoroalkoxy polymer.

8. The cable in accordance with claim 1, wherein the fluid to be transported in the at least one tube is a corrosion inhibitor.

* * * * *